US008283610B2

(12) United States Patent
Hirano

(10) Patent No.: US 8,283,610 B2
(45) Date of Patent: Oct. 9, 2012

(54) METHOD AND DEVICE TO OPEN AND CLOSE DRAWER-TYPE COOKING DEVICE

(75) Inventor: Hiroshi Hirano, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 1148 days.

(21) Appl. No.: 12/141,665

(22) Filed: Jun. 18, 2008

(65) Prior Publication Data

US 2008/0315739 A1 Dec. 25, 2008

(30) Foreign Application Priority Data

Jun. 19, 2007 (JP) ..... 2007-160870

(51) Int. Cl.

| | |
|---|---|
| ***H05B 3/06*** | (2006.01) |
| ***H05B 6/64*** | (2006.01) |
| ***H05B 6/76*** | (2006.01) |
| ***A47B 88/12*** | (2006.01) |
| ***A47B 88/04*** | (2006.01) |

(52) U.S. Cl. ..... 219/520; 219/752; 219/762; 219/391; 126/192; 312/330.1; 310/12.01; 310/12.19

(58) Field of Classification Search ..... 219/520, 219/752, 756, 681, 494, 385–404; 99/516
See application file for complete search history.

(56) References Cited

U.S. PATENT DOCUMENTS

| | | | | |
|---|---|---|---|---|
| 6,734,582 | B2 * | 5/2004 | Corbett et al. | 310/12.01 |
| 6,849,835 | B2 | 2/2005 | Bollmers et al. | |
| 6,917,016 | B2 * | 7/2005 | Backer et al. | 219/392 |
| 7,078,662 | B2 * | 7/2006 | Yoshidome | 219/756 |
| 7,241,978 | B2 * | 7/2007 | Iwamoto | 219/414 |
| 7,244,916 | B2 * | 7/2007 | Iwamoto | 219/756 |
| 7,282,884 | B2 * | 10/2007 | Huber et al. | 318/646 |
| 7,488,119 | B2 * | 2/2009 | Yoshida et al. | 385/89 |
| 2002/0145341 | A1 * | 10/2002 | Corbett et al. | 310/12 |
| 2004/0070287 | A1 * | 4/2004 | Corbett et al. | 310/12 |
| 2005/0173399 | A1 * | 8/2005 | Yoshidome et al. | 219/403 |
| 2005/0173426 | A1 * | 8/2005 | Iwamoto | 219/752 |
| 2006/0289512 | A1 * | 12/2006 | Iwamoto | 219/722 |
| 2007/0170828 | A1 * | 7/2007 | Hoshide et al. | 312/319.5 |

FOREIGN PATENT DOCUMENTS

| | | | |
|---|---|---|---|
| EP | 1710380 | A1 * | 10/2006 |
| JP | 03-045820 | A | 2/1991 |
| JP | 06-109257 | A | 4/1994 |
| JP | 11-237053 | A | 8/1999 |
| JP | 2005-221081 | A | 8/2005 |
| JP | 2006-038296 | A | 2/2006 |

* cited by examiner

*Primary Examiner* — Joseph M Pelham
(74) *Attorney, Agent, or Firm* — Birch, Stewart, Kolasch & Birch, LLP

(57) ABSTRACT

Methods and devices for opening and closing a door of a drawer-type cooking device, enabling reduction in operation force by causing a drive mechanism not to put a load during an initial period when the door is opened or closed are provided. When a drawer body is driven by a drive mechanism including an electric motor to reach a stroke end such as a fully closed (opened) position, the drive mechanism is reversely driven only for a distance corresponding to a backlash existing in a transmission mechanism (between a pinion and a rack) and is stopped. When the drawer body is manually operated in the direction away from the stroke end, the drawer body moves without driving the drive mechanism against the inertia or load only for the distance corresponding to the backlash. As a result, the drawer body can start to be manually moved with a light burden.

8 Claims, 10 Drawing Sheets

ASSISTING OF MANUAL OPERATION

CW/CCW··· High : Open, Low : Close

POSITIONAL RELATIONSHIP BETWEEN LATCH HEAD AND CLOSE SW

METHOD AND DEVICE TO OPEN AND CLOSE DRAWER-TYPE COOKING DEVICE

The present application is based on and claims priority of Japanese patent application No. 2007-160870 filed on Jun. 19, 2007.

BACKGROUND OF THE INVENTION

1. Field of the Invention

The present invention relates to a method and device for opening and closing a door of a drawer-type cooking device including a cooking device body having a heating chamber, a drawer body movably disposed such that the drawer body can be drawn out from the heating chamber of the cooking device body to the outside, and a drive mechanism for driving the drawer body in the draw-out and push-in directions via a transmission mechanism.

2. Description of the Related Art

In the related art, there has been proposed a cooking device comprising an apparatus body having a cooking chamber in which an object to be cooked is housed, a door for shielding the cooking chamber from outside, a bottom plate moving in conjunction with the door, a sliding mechanism for sliding the bottom plate out of/in the cooking chamber, a motor for driving the bottom plate, transmission means for transmitting a drive force of the motor to the bottom plate, a latch device for opening and retaining the door, a door open/close switch, and a control circuit for controlling drive of the motor so as to operate the door upon reception of a signal from the door open/close switch (Japanese Patent Laid-Open Publication No. 3-45820 (Patent Document 1)). The bottom plate is directly coupled to the lower portion of the door in the vicinity of the lower hem. When the door is opened, the sides of the bottom plate are in an open state.

Also, there has been proposed a cooking device in which a slide body in which an object to be heated is housed is slidably provided in a cooking device body, comprising detecting means for detecting that the slide body has been slid out, control means for outputting an excitation command signal when receiving a detection signal from the detecting means, and an electromagnet leg portion disposed on the bottom face of the cooking device body and excited when receiving the excitation command signal (Japanese Patent Laid-Open Publication No. 6-109257 (Patent Document 2)). When the slide body is slid out, the excitation command signal is output from the control means based on detection by the detecting means, and the electromagnet leg portion disposed on the bottom face of the cooking device body is excited. The electromagnet leg portion is chucked to a metallic placing face to prevent the cooking device from being turned over, so as to use the cooking device in a stable state all the time.

Also, there has been proposed an microwave oven, wherein a heating container having an opening in its top is provided so as to be freely drawn out from a body housing, a heating chamber for confining microwave is formed by the heating container and a lid portion provided in the body housing side and covering the opening of the heating container, and electromagnetic wave leakage is prevented by providing a choke groove between an opening peripheral portion of the heating container and the lid portion facing the opening peripheral portion, so as to eliminate the electromagnetic wave leakage even if a food placing portion has a movable drawer structure (Japanese Patent Laid-Open Publication No. 11-237053 (Patent Document 3)).

There has been proposed a cooking device in which a placing portion of an object to be heated of a heating chamber has a drawable structure, comprising a cooking device body having a heating chamber, a drawer body movably disposed in the cooking device body such that the drawer body can be drawn out from the heating chamber of the cooking device body to the outside, and a slide rail for moving the drawer body in the cooking device body, wherein the slide rail is disposed outside of the heating chamber, so that it is not necessary to form the sliding mechanism with a part or a material having high heat resistance and flame resistance and it is possible to prevent the occurrence of faulty discharge by microwave (Japanese Patent Laid-Open Publication No. 2005-221081 (Patent Document 4)).

There has been proposed a slide-type cooking device, wherein a drawer body having a door and a heating container in which an object to be heated is placed therein is disposed in a cooking device body in which a heating chamber using microwave is formed therein, in a movable manner between a housed position where the heating container is housed in the heating chamber, and a drawn-out position where the heating container is drawn out from the heating chamber to the outside, and a sliding mechanism allowing the drawer body to be moved is constituted by right and left slide rails outside of the heating chamber and a center slide rail in which a drive mechanism is disposed, the respective slide rails and the drive mechanism being disposed isolatedly from the heating chamber, so that the slide rails and the drive mechanism are not exposed to a high temperature and a microwave or are not affected by food debris which could cause a breakdown (Japanese Patent Laid-Open Publication No. 2006-38296 (Patent Document 5)). Also, there has been disclosed a drawer-type food warmer having a moving rail only on the bottom face and in which the right and left side faces are opened (U.S. Pat. No. 6,849,835B2 (Patent Document 6)).

The inventions described in the above respective documents seem to have following points to be improved concerning supporting of the door. That is, in the inventions disclosed in Japanese Patent Laid-Open Publication No. 3-45820, Japanese Patent Laid-Open Publication No. 6-109257 and Japanese Patent Laid-Open Publication No. 11-237053 (Patent Documents 1 to 3), the lower side portion of the door is only butt against the bottom plate to be fixed thereto. Thus, in the case where the door is heavily loaded by body weight, a heated object or the like, an attachment portion of the door and the bottom plate could be deformed. If the attachment portion is deformed, there is a possibility that microwave for heating leaks from a gap generated between the inclined door and the body to the outside, and it is necessary to handle the apparatus with enough caution concerning the load onto the door.

In Patent Document 4, the moving mechanism is provided in right and left side walls outside of the heating chamber, and an angle member for attaching the moving mechanism is fixed to the door. Therefore, a force acting on the door is supported by the cooking device body by being relatively dispersed via the moving mechanism provided in the right and left and the center of the lower portion. When the drawer body is drawn out, the door is not inclined forward and is stably supported by the cooking device body. However, in Patent Document 4, the moving mechanism disposed in the right and left side wall faces extend through the right and left sides of the heating container when the drawer body is drawn out. Thus, when an object to be heated, for example, a heavy object such as a pot with soup therein or the like is put into or removed from the heating container which is combined with the door, the moving mechanism stands in the way, and the usability is low. Furthermore, from the standpoint of appearance, the visual quality needs to be improved. Also, Patent Document 5, in which the moving mechanism for supporting the door of the drawer body is disposed at three places of right and left side wall faces and a bottom wall face outside of the heating chamber, has the similar points to be improved as those of Patent Document 4. Furthermore, although Patent Document 6 has such a similar point with respect to the drawer structure, discloses not the cooking device, but an electric warming device, in which the drawer is only manually operated and does not have an electric moving mechanism. The electric warming device does not have an electromagnetic wave sealing mechanism or a latch hook as a safety mechanism since it is not a microwave oven. Since the drawer does not have the electric mechanism, a moving mechanism simply by a lower rail is employed.

FIG. 9 is a perspective view of a drawer-type cooking device having a conventional structure. FIG. 10 is a side view of the drawer-type cooking device shown in FIG. 9. A cooking device body 1 has a heating chamber 3 for cooking an object to be heated. A drawer body 2 is movably, namely, slidably disposed in the cooking device body 1 such that the drawer body 2 can be drawn out from the heating chamber 3 of the cooking device body 1 to the front side. The cooking device comprises a movable rail 8 formed of an angle member as a moving mechanism 4 for slidingly moving the drawer body 2 in the cooking device body 1. The drawer body 2 comprises a door 6 for opening and closing the heating chamber 3 and a heating container 7 for placing and housing an object to be heated. The heating container 7 has side walls in the right and left sides, a back wall in the back side disposed in the heating chamber 3 of the cooking device body 1, and an opening in the top, and the door 6 is attached to the front thereof. When the door 6 closes an opening of the heating chamber 3, the internal space of the heating chamber 3 becomes a sealed space by internal wall faces of the cooking device body 1 and the drawer body 2, so as to prevent microwave from leaking.

The door 6 of the drawer body 2 is supported by the cooking device body 1 by right and left side wall faces located outside of the heating chamber 3 via the moving mechanism 4. The moving mechanism 4 comprises a fixed rail 9 and the movable rail 8 sliding along the fixed rail 9. The fixed rail 9 is attached to the right and left wall faces of the heating chamber 3 outside of the heating chamber 3 of the cooking device body 1. The movable rail 8 is attached to an internal side wall face of the door 6 via a fitting 10 so as to extend from the internal side wall face of the door 6 to the inside of the cooking device body 1. Since the moving mechanism 4 for moving the drawer body 2 in the cooking device body 1 is disposed outside of the heating chamber 3, it is not necessary to use an expensive part or material having high heat resistance and flame resistance for the movable rail 8 and the fixed rail 9 which constitute the moving mechanism 4. Also, since the moving mechanism 4 is disposed outside of the heating chamber 3, a risk of discharge by microwave is eliminated without being affected by microwave emitted in the heating chamber 3.

In the known drawer-type cooking device, when the door is opened and closed by a manual operation, a large operation force is required and the operability decreases. The operability further decreases especially in the case of old people and children. In order to solve such a decrease in the operability, the drawer-type cooking device has an automatic opening and closing door driven by a motor. However, when the door in a fully closed position or in a fully opened position starts to be manually moved in the opposite direction (the fully closed door is opened or the fully opened door is closed), a large force is required.

Since it is necessary to generate a high drive force at a low speed, the moving mechanism is driven via a transmission mechanism including a reduction gear having a high reduction ratio in relation to a motor. This means that, when a rotator of the motor is seen as an object to be driven in relation to the drawer body, which is moved by a manual operation, a drive load obtained by amplifying a load by the rotator of the motor in proportion to the reduction ratio is connected to the drawer body. That is, in the case where the drawer body of the cooking device is moved by a manual operation, the rotator of the motor is to be driven via the moving mechanism, and a very high drive load in comparison with a load expected to be generated from the motor shape and the movement of the single rotator is generated. The operation force required at this time is a considerably large operation force in comparison with an operation force required in the case of a drawer-type cooking device which does not have the automatic opening and closing door driven by a motor and is manually opened and closed.

Accordingly, in a drawer-type cooking device comprising a cooking device body having a heating chamber formed therein, a drawer body having a heating container for housing an object to be heated and being drawable from the heating chamber and a door capable of closing the heating chamber, and a drive mechanism for driving the drawer body in the draw-out and push-in directions via a transmission mechanism, when the drawer body having the door starts to be manually moved in the opposite direction at a stroke end thereof, there is such a problem to be solved to at least cause the drive mechanism not to put a load during an initial period thereof.

An object of the present invention is to provide a method and device for opening and closing a door of the drawer-type cooking device, enabling to reduce the operation force by at least causing the drive mechanism not to put a load during the initial period when the door is opened or closed.

In the field of microwave oven, new distinct configuration of automatic drawer type is emerging of late, for which this invention is intended for a further improvement. This invention takes advantage of the backlash of the drawer driving mechanism; the drawer body is without the burden of the motor when the drawer is drawn within the short reign of the backlash immediately from the fully-closed position, enabling to activate the mechanism by means of a microswitch while the drawer load stays light.

SUMMARY OF THE INVENTION

In order to achieve the above object, a method for opening and closing a door of a drawer-type cooking device according to the present invention comprises, at a stroke end of the drawer body corresponding to a fully closed position or a fully opened position of the door, reversely driving the drive mechanism as far as to the end of backlash existing in the transmission mechanism and stopping the drive mechanism.

Also, a device for opening and closing a door of a drawer-type cooking device according to the present invention further comprises a control unit for controlling the drive mechanism, wherein, at a stroke end of the drawer body corresponding to a fully closed position or a fully opened position of the door, the control unit reversely drives the drive mechanism as far as to the end of backlash existing in the transmission mechanism and stops the drive mechanism.

According to the method and device for opening and closing a door of a drawer-type cooking device, when the drawer body is driven by the drive mechanism to reach the stroke end such as the fully closed position or the fully opened position, the drive mechanism is reversely driven as far as to the end of backlash existing in the transmission mechanism and then is stopped. Therefore, when the drawer body is manually operated in the direction away from the stroke end next time, namely, in the opening direction in the case where the stroke end is the fully closed position, or in the closing direction in the case where the stroke end is the fully opened position, the drawer body can be moved without driving the drive mechanism against the inertia or load as far as to the end of backlash. As a result, the drawer body can start to be manually moved with a light burden.

Also, in response to that the drawer body starts to be moved in the opposite direction from the stroke end when the drive mechanism is in a non-driven state, the drive mechanism can start in the opposite direction before the drawer body is moved through the distance corresponding to the backlash. By adjusting the timing of starting the drive mechanism as described above, the drive mechanism can assist subsequent movement of the drawer body which is manually started.

Since the present invention is configured as described above, when the door starts to be manually moved in the opposite direction from the stroke end, it is not necessary to at least manually start driving the drive mechanism and a necessary operation force can be reduced. Accordingly, the operability of moving the drawer body during the manual operation is improved.

Also, the timing of starting the drive mechanism is adjusted such that, in response to that the drawer body starts to be moved in the opposite direction from the stroke end when the drive mechanism is in a non-driven state, the drive mechanism can start in the opposite direction before the drawer body is moved through the distance corresponding to the backlash. Accordingly, the subsequent movement of the drawer body which is manually started is driven by the drive mechanism, and the manual operation by a user can be assisted.

DETAILED DESCRIPTION OF THE PREFERRED EMBODIMENTS

Figure 1:
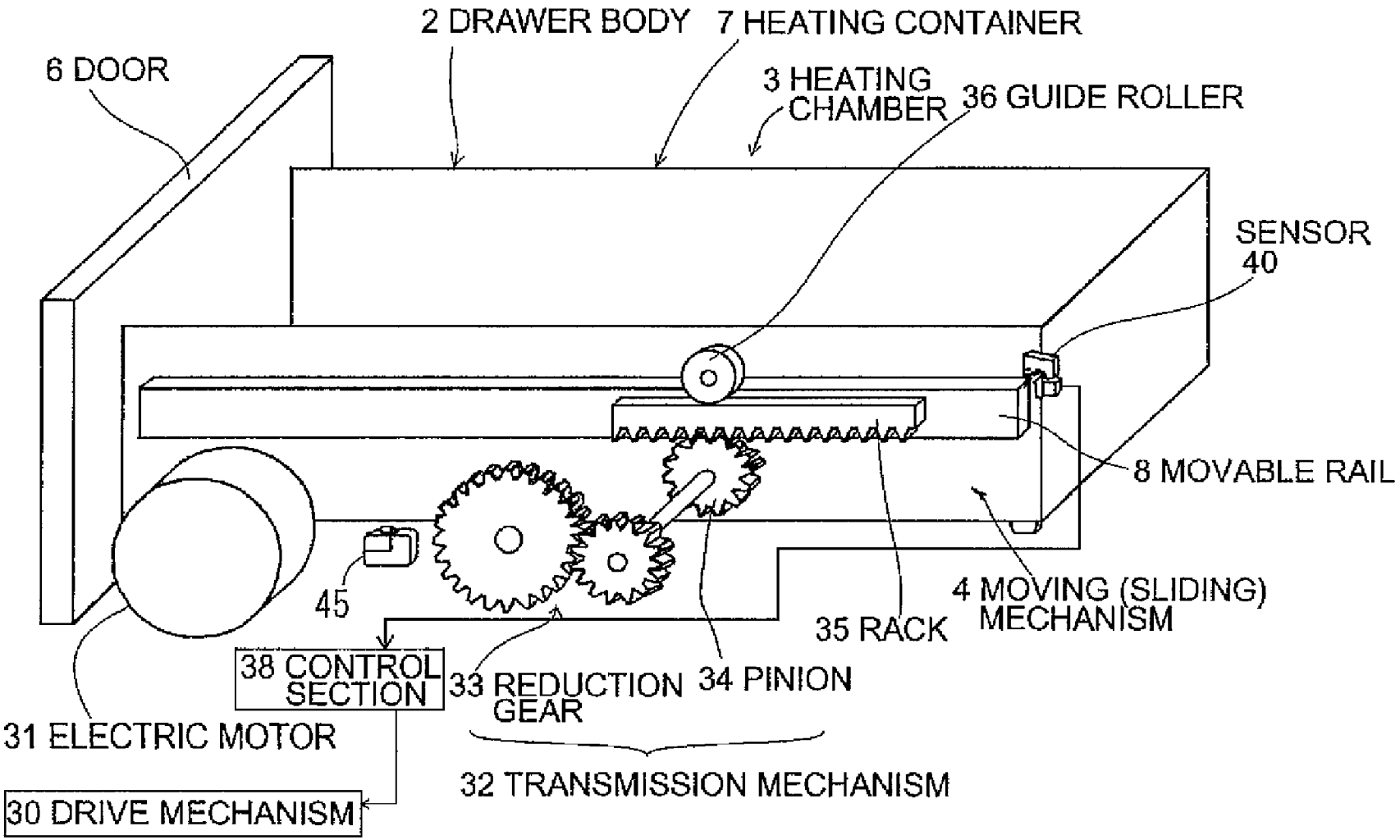
FIG. 1 is a perspective view illustrating a removed main portion (a device for opening and closing a door) of a drawer-type cooking device to which a method and device for opening and closing a door according to the present invention is applied.

An embodiment of a method and device for opening and closing a door of a drawer-type cooking device according to the present invention will be described below based on the accompanying drawings. FIG. 1 is a perspective view illustrating a removed main portion (a device for opening and closing a door) of a drawer-type cooking device to which the method and device for opening and closing a door according to the present invention is applied.

Figure 9:
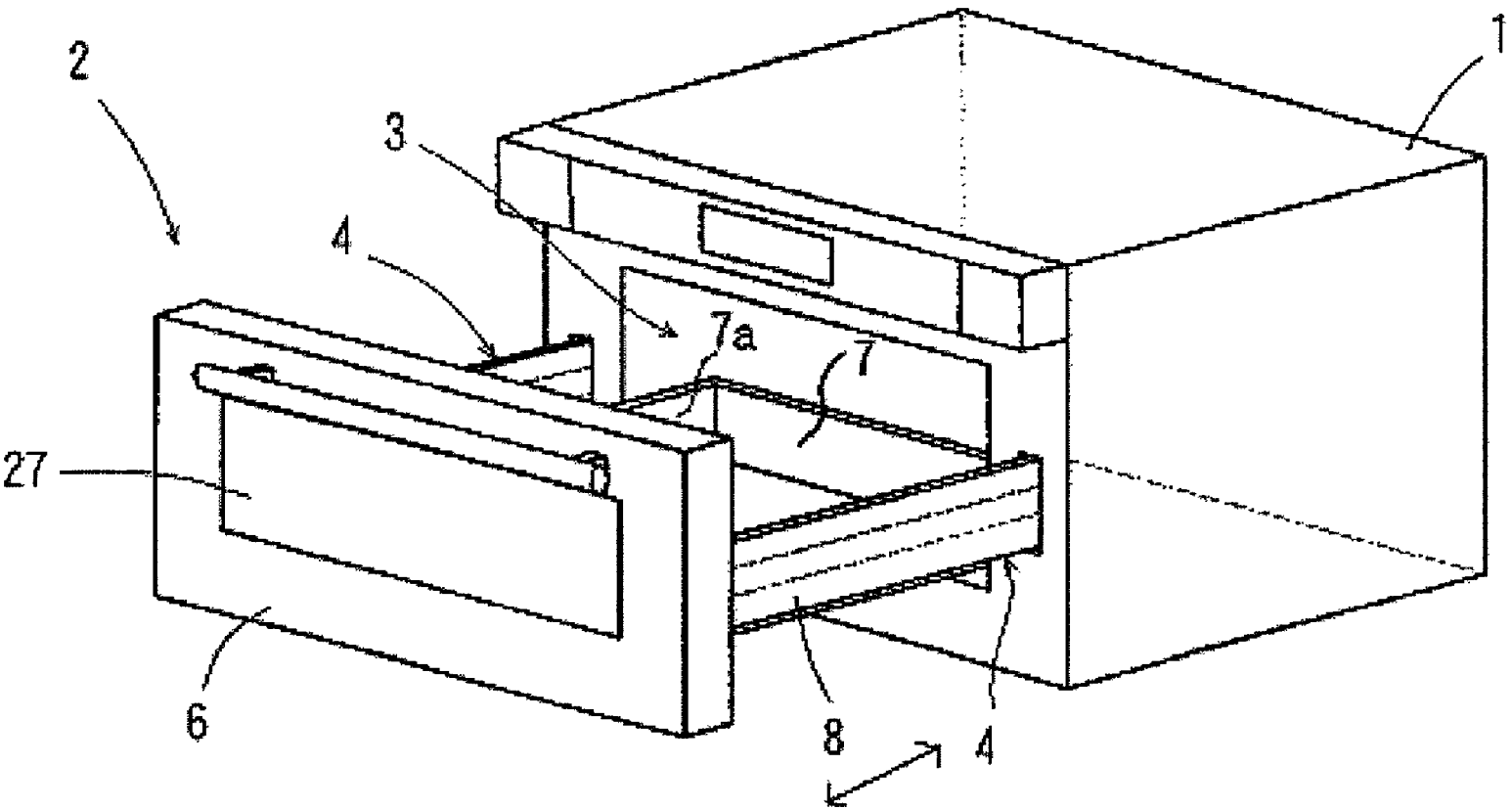
FIG.9 PRIOR ART
FIG. 9 is a perspective view schematically illustrating a known drawer-type cooking device.
Figure 10:
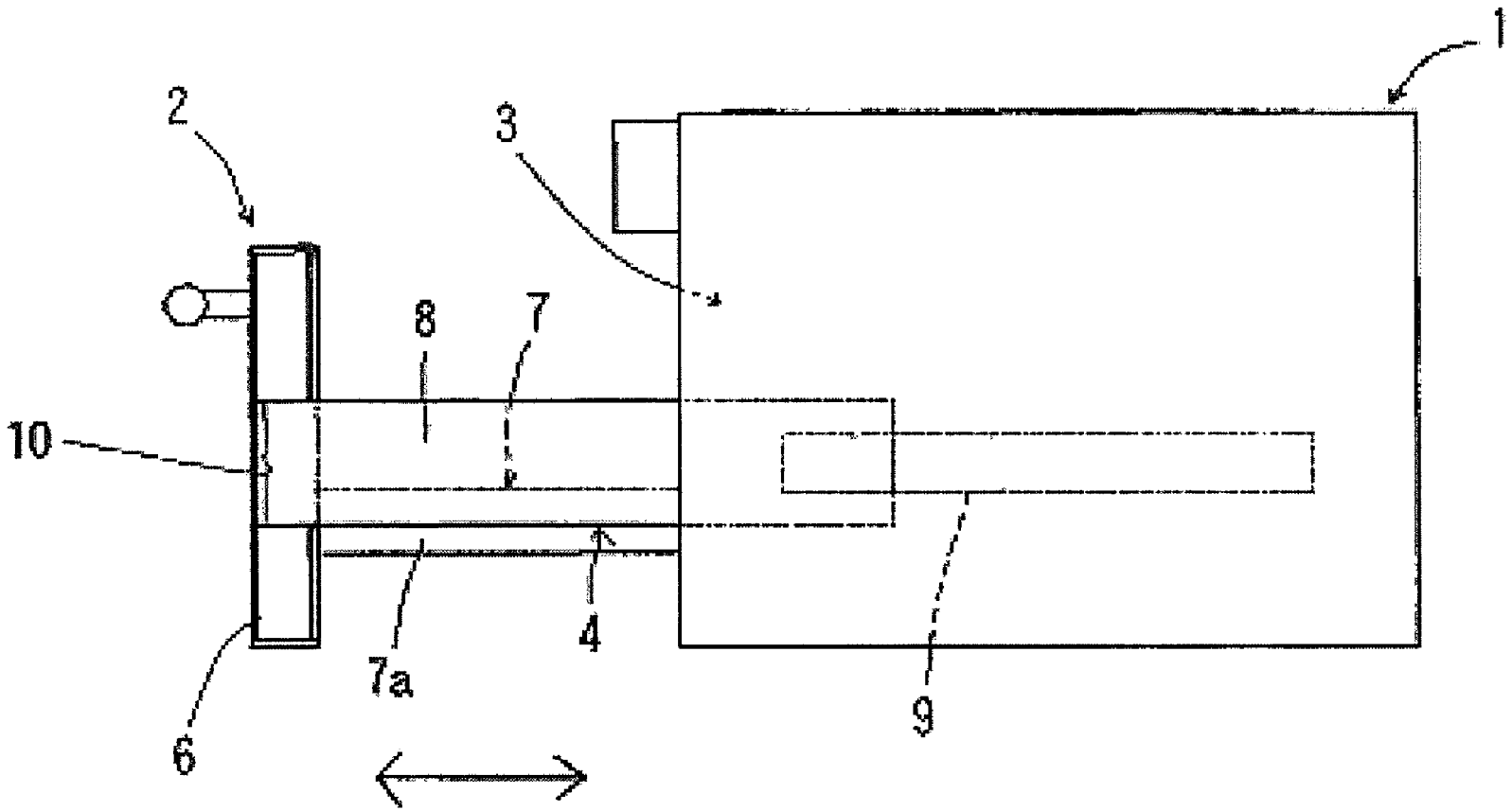
FIG.10 PRIOR ART
FIG. 10 is a side view of the known drawer-type cooking device shown in FIG. 9.

In the embodiment of the method and device for opening and closing a door of a drawer-type cooking device according to the present invention shown in FIG. 1, like reference numerals are used for like elements to those used in a known drawer-type cooking device shown in FIG. 9 and FIG. 10.

In the drawer-type cooking device shown in FIG. 1, a drawer body 2 can be drawn out from a cooking device body to the front side, or conversely, pushed into the cooking device body by a moving (sliding) mechanism 4. The moving mechanism 4 comprises a movable rail 8 attached to a heating container 7 which is integrally formed with a door 6 of the drawer body 2, and a fixed rail fixed to the cooking device body and slidably engaging with the movable rail 8 by a known structure. The moving mechanism 4 is disposed in side positions and a bottom face position of the heating container 7.

The cooking device body is provided with a drive mechanism 30 and a transmission mechanism 32 in such a manner that the drive mechanism 30 and the transmission mechanism 32 are incorporated in the moving mechanism 4 provided to the heating container 7 which is integrally formed with the door 6 of the drawer body 2 and in which an object to be heated is housed. The drive mechanism 30 comprises an electric motor 31 attached to the cooking device body 1. The transmission mechanism 32 comprises a reduction gear 33 coupled to an output shaft of the electric motor 31 via a timing belt (not shown), and a pinion 34 meshing with the reduction gear 33. The moving mechanism 4 further comprises a rack 35 attached to the movable rail 8, and a guide roller 36 sandwiching the rack 35 with the pinion 34. Although the reduction gear 33 of the transmission mechanism 32 is shown to have a single stage, the reduction gear 33 may be a reduction gear train having a plurality of stages connected in series. In this case, an output torque in the last stage can be improved.

When the pinion 34 as the last stage of the transmission mechanism 32 is rotated by rotation of the electric motor 31, the rack 35 sandwiched between the pinion 34 and the guide roller 36 is driven. In the moving mechanism 4, the movable rail 8 slides on the fixed rail disposed in the cooking device body, and the drawer body 2 is thereby guided and opened or closed. Also, a sensor 40 is disposed in a fully closed position of the door 6. A detection signal of the sensor 40 is sent to a control unit 38, which controls the drive mechanism 30 based on the detection content. In addition to the sensor in the fully closed position, a sensor 45 for detecting a fully opened position and for assisting a manual operation is also provided in the fully opened position. In order to prevent a user from getting his/her fingers stuck in the door during a closing operation of the door, for example, the moving speed of the door is reduced in a zone immediately before the door is completely closed as the countermeasure. The zone is detected from a rotation signal of the motor based on the fully opened position, and thus, it is necessary to detect the fully opened position.

[Electric Door Closing Operation]

Figure 2:
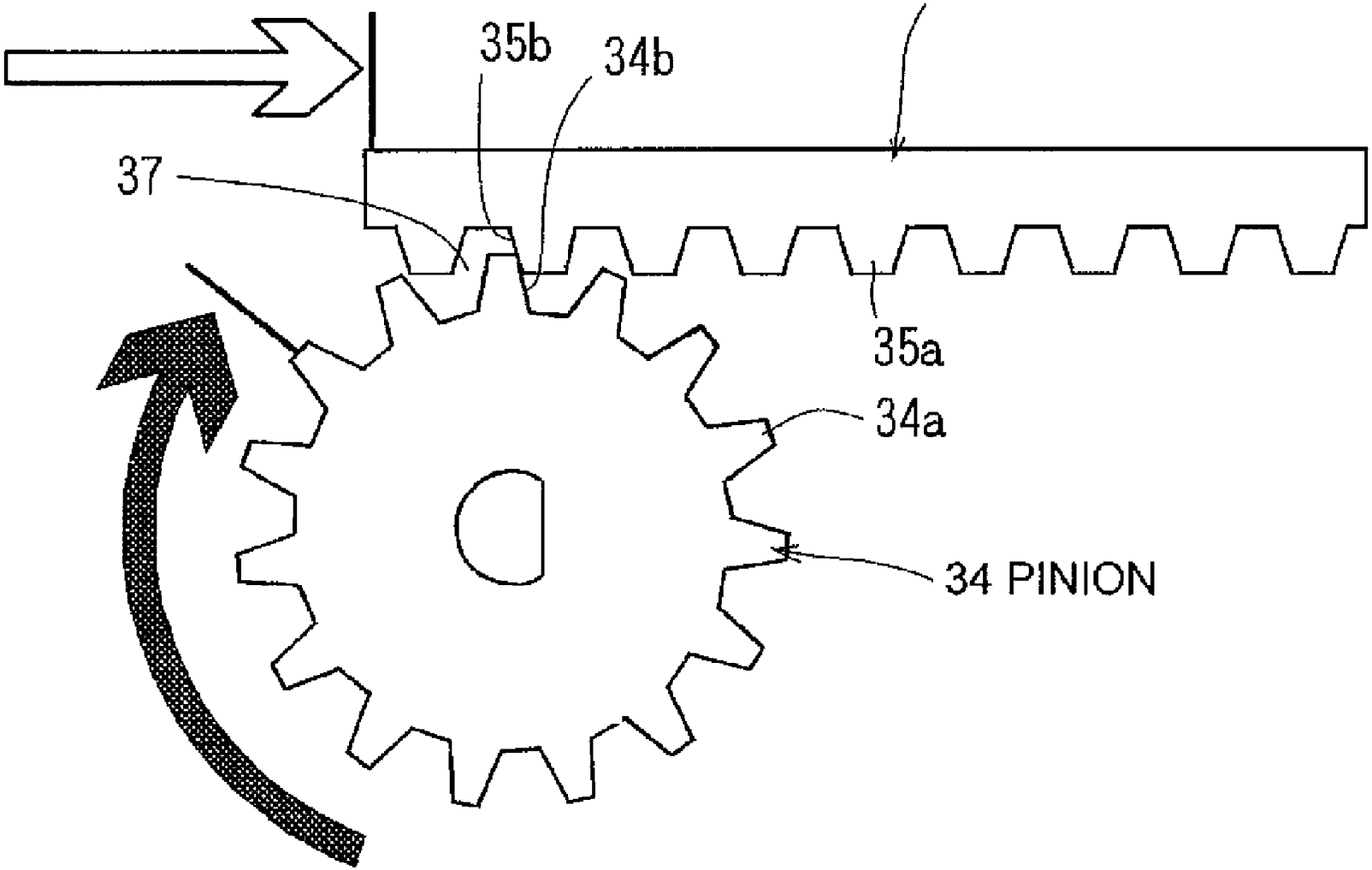
FIG. 2 is an explanatory view of an electric door closing operation of the device for opening and closing a door shown in FIG. 1.

FIG. 2 is an explanatory view of an electric door closing operation of the device for opening and closing a door shown in FIG. 1. In the electric door closing operation, the rack 35 is moved in the right direction by clockwise rotation of the pinion 34, and the drawer body 2 is thereby moved in the right direction to close the door 6. At the moment when the door 6 is closed, a clockwise side tooth face 34*b* of a tooth 34*a* of the pinion 34 is in abutment with a drawer front side tooth face 35*b* of a tooth 35*a* of the rack 35.

[Returning Operation]

Figure 3:
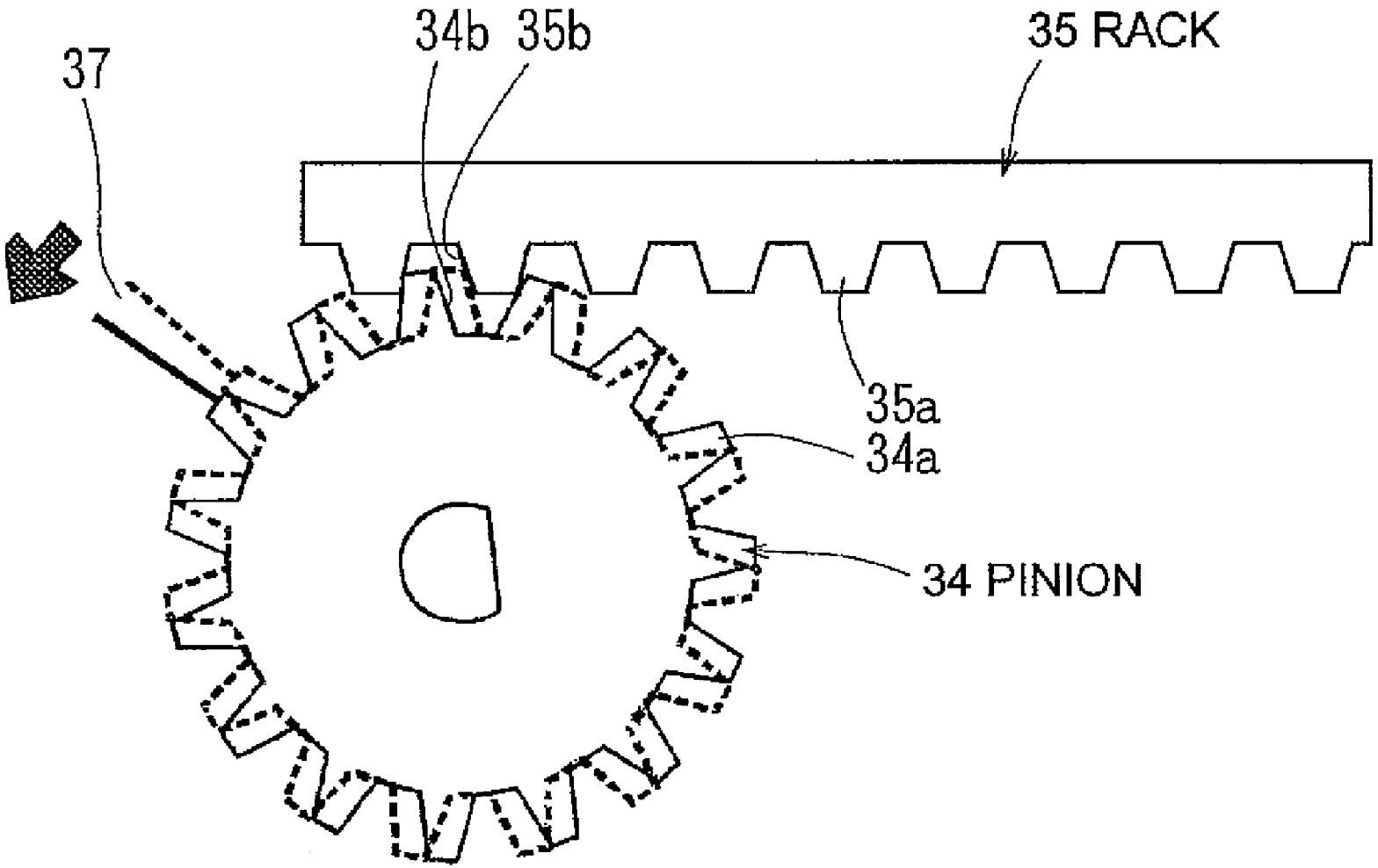
FIG. 3 is an explanatory view of a returning operation of the device for opening and closing a door shown in FIG. 1.

FIG. 3 is an explanatory view of a returning operation of the device for opening and closing a door shown in FIG. 1. If the pinion 34 is rotated a small angle in the counterclockwise direction when the rack 35 is completely moved in the right direction, that is, when the rack 35 reaches a stroke end as the fully closed position as shown in FIG. 2, the pinion 34 is freely rotated in the counterclockwise direction till the tooth faces thereof abut against the tooth faces of the rack 35 since a backlash 37 exists between the pinion 34 and the rack 35. In other words, the pinion 34 is rotated the small angle corresponding to the backlash 37 existing between the pinion 34 and the rack 35 which constitute the transmission mechanism 32, and the backlash 37 is absorbed in the counterclockwise direction in the drawing.

The control unit 38 stops rotating the electric motor 31 based on the signal from the sensor for detecting that the tooth 34*a* of the pinion 34 is brought into abutment with the tooth 35*a* of the rack 35, and thereby stops rotating the pinion 34 to obtain the small angle. In other words, since an output torque of the electric motor 31 at the time of the reverse rotation is controlled to be a minimum torque by which the output shaft of the electric motor 31 is rotated but the door 6 is not actually opened, the rotation of the electric motor 31 is stopped when the tooth 34*a* of the pinion 34 is brought into abutment with the tooth 35*a* of the rack 35. Thus, the rotation of the small angle can be detected by detecting the rotation of the motor 31. Also, in the present embodiment, the backlash 37 exists between the pinion 34 and the rack 35. In this case, it is not necessary to manually drive the transmission mechanism 32 as well as the drive mechanism 30, and an operation force required during a manual operation becomes smallest. The above small angle can be set in advance as a predetermined period for driving the electric motor 31. The predetermined period can be also set as a motor drive time or a drive pulse number for obtaining an output rotation angle of the electric motor 31 corresponding to a rotation angle of the pinion 34, or a period from when the backlash is absorbed until when a load increase is detected. Also, it is apparent that the backlash can dispersedly exist in a mesh between the gears of the reduction gear 33 other than between the pinion 34 and the rack 35.

[Door-open Detecting Operation with Respect to Manual Opening of the Door]

Figure 4:
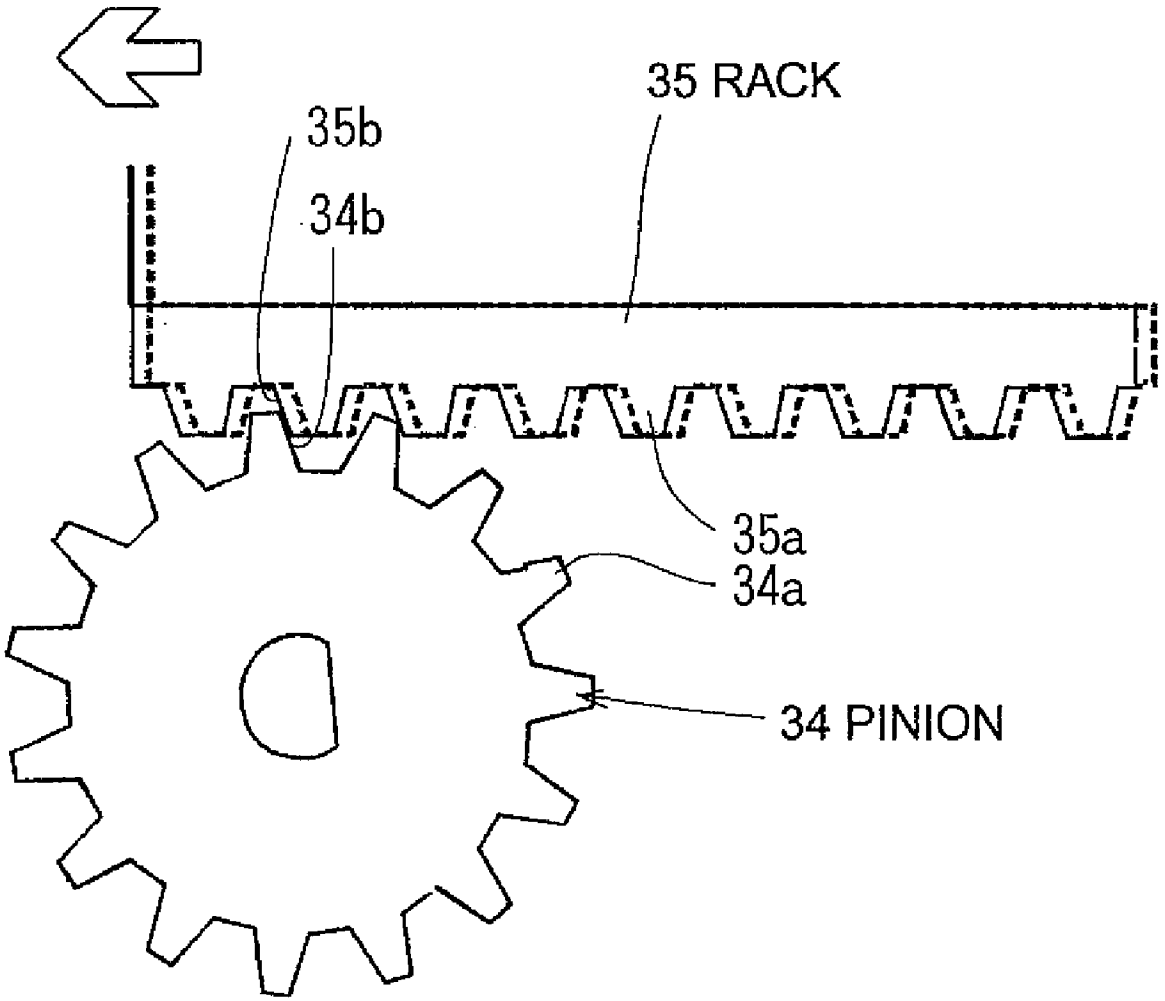
FIG. 4 is an explanatory view of a door-open detecting operation with respect to manual opening of a door of the device for opening and closing a door shown in FIG. 1.

FIG. 4 is an explanatory view of a door-open detecting operation with respect to manual opening of the door of the device for opening and closing a door shown in FIG. 1. The backlash 37 existing between the pinion 34 and the rack 35, namely, between the clockwise side tooth face 34*b* of the tooth 34*a* of the pinion 34 and the drawer front side tooth face 35*b* of the tooth 35*a* of the rack 35 becomes the maximum at the time of manually opening the door. Therefore, when the drawer body 2 is moved in the door opening direction by the manual operation, the drawer body 2 is freely moved with respect to the transmission mechanism 32 (the pinion 34 and the reduction gear 33) and the drive mechanism 30 for a distance corresponding to the backlash 37 of the rack 35 and the pinion 34.

[Assisting Operation of the Manual Operation]

At the time of opening the door by the manual operation, the user's hand is not burdened since the drawer body 2 and the drive mechanism 30 are separated from each other. The control unit 38 detects the free movement of the drawer body 2, and activates the drive mechanism 30 by the time the rack 35 is moved only for the distance corresponding to the backlash 37 and the tooth 35*a* of the rack 35 engages with the tooth 34*a* of the pinion 34, so as to perform an electric door opening operation. Accordingly, the assisting of the manual operation with good operability is enabled.

Figure 5A:
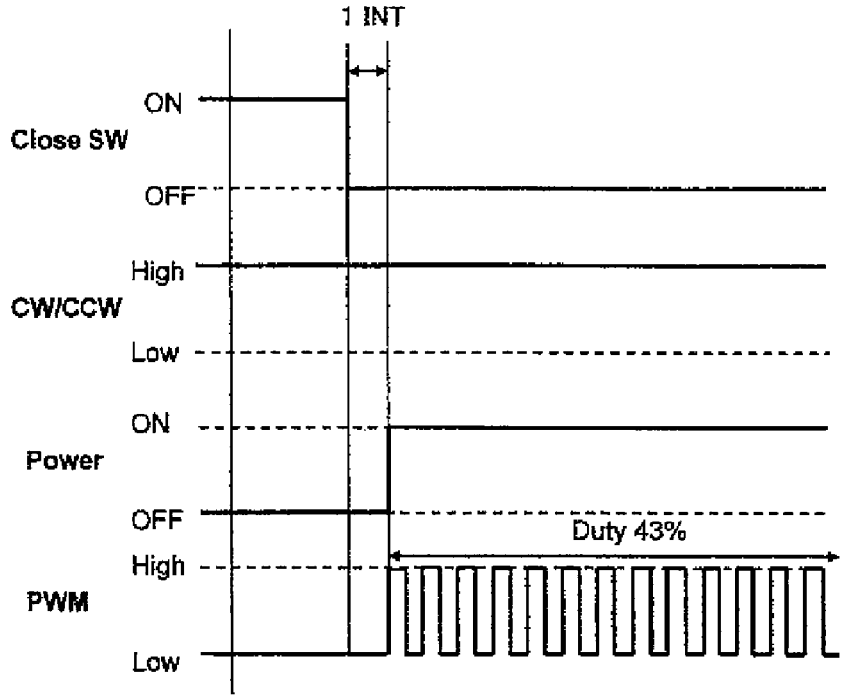
FIG. 5 illustrates one example of a timing chart for explaining an assisting operation of a manual operation in the device for opening and closing a door shown in FIG. 1.

FIG. 5 illustrates one example of a timing chart for explaining the assisting operation of the manual operation. As shown in FIG. 5(A), when a close switch of the door is changed from ON to OFF by manually opening the door in the fully closed position, power supply (Power) is switched from OFF to ON after 1 INT (the minimum time unit of an internal clock of the control unit 38, for example, 1/60 second), and pulse width control of the electric motor is performed at a duty ratio of 43%. As to CW (clockwise direction)/CCW (counterclockwise direction), a "High" signal shows the direction of opening the door (Open) in the CW. A "Low" signal shows the direction of closing the door (Close) in the CCW.

Figure 5B:
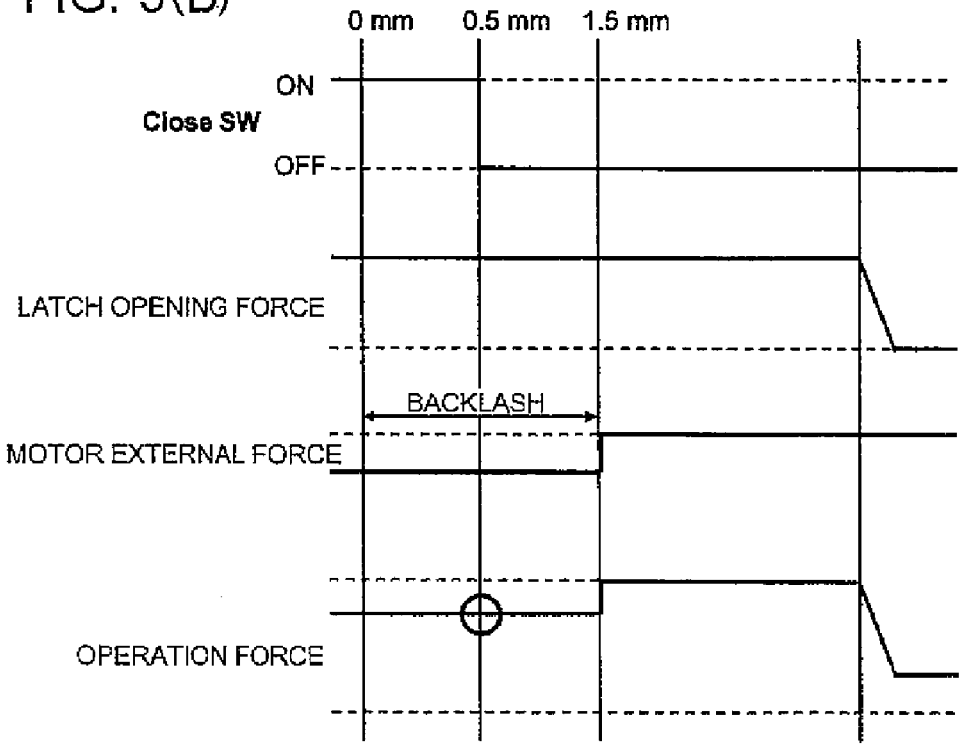

Also, as shown in FIG. 5(B), when the door is opened 0.5 mm from the fully closed position, the close switch is switched OFF and the assisting of the manual operation is started. It is necessary to move a longer distance than the backlash (1.5 mm in the graph) in order to escape from engagement with a latch disposed in the close switch provided at the stroke end. To open the latch, it is necessary to overcome a spring force (see a spring 43 in FIG. 6) provided in relation to the latch. Since the backlash existing in the transmission mechanism is larger than a start position of assisting the manual operation (0.5 mm open), the manual operation force is lightened during a period of the backlash. A motor external force is a force given to the door by the motor, which corresponds to that the output torque is a minimum torque during the period of the backlash and is raised to a predetermined torque after the period of the backlash. If the start position of assisting the manual operation is set to be shorter than 0.5 mm, there is a possibility that reduction in the manual operation force cannot be expected. Also, if the start position of assisting the manual operation is set to be longer than 1.5 mm, the start position exceeds the maximum value of the backlash, and there is a risk that a plunger (see reference numeral 41 in FIG. 6) of the close switch is pushed up. From the perspective of the durability of the close switch, it is preferable to adjust the start position of assisting the manual operation not to exceed 1.5 mm.

Figures 6A, 6B, 6C:
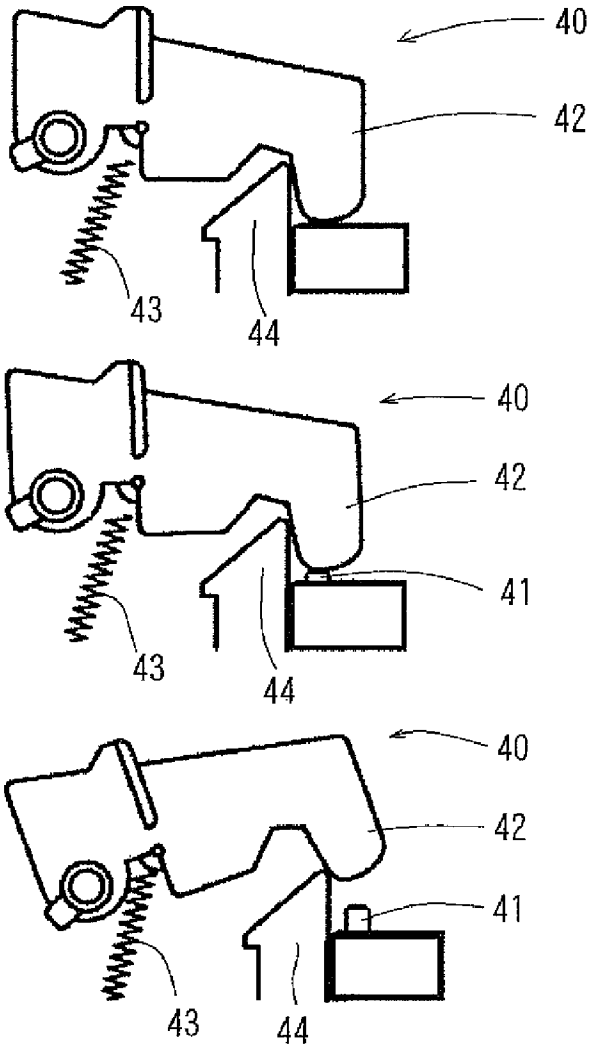
FIG. 6 illustrates the positional relationship between a latch head and a close switch in the device for opening and closing a door shown in FIG. 1.

FIG. 6 illustrates the positional relationship between a latch head and the close switch. FIG. 6(A) illustrates the positional relationship between a latch head 42 and a close switch 40 in the fully closed state, and the state in which a plunger 41 of the close switch 40 is completely pressed down is shown therein. FIG. 6(B) illustrates an operation point as the time when the close switch 40 is switched between ON and OFF, which corresponds to the state in which the door is opened only 0.5 mm from the fully closed position. FIG. 6(C) illustrates the state in which the close switch 40 completely escapes from engagement with a hook 44. A spring 43 interposed between the head 42 and the drawer body 2 is urged in the direction of maintaining engagement with the hook 44 after the head 42 moves over the hook 44.

Figure 7:
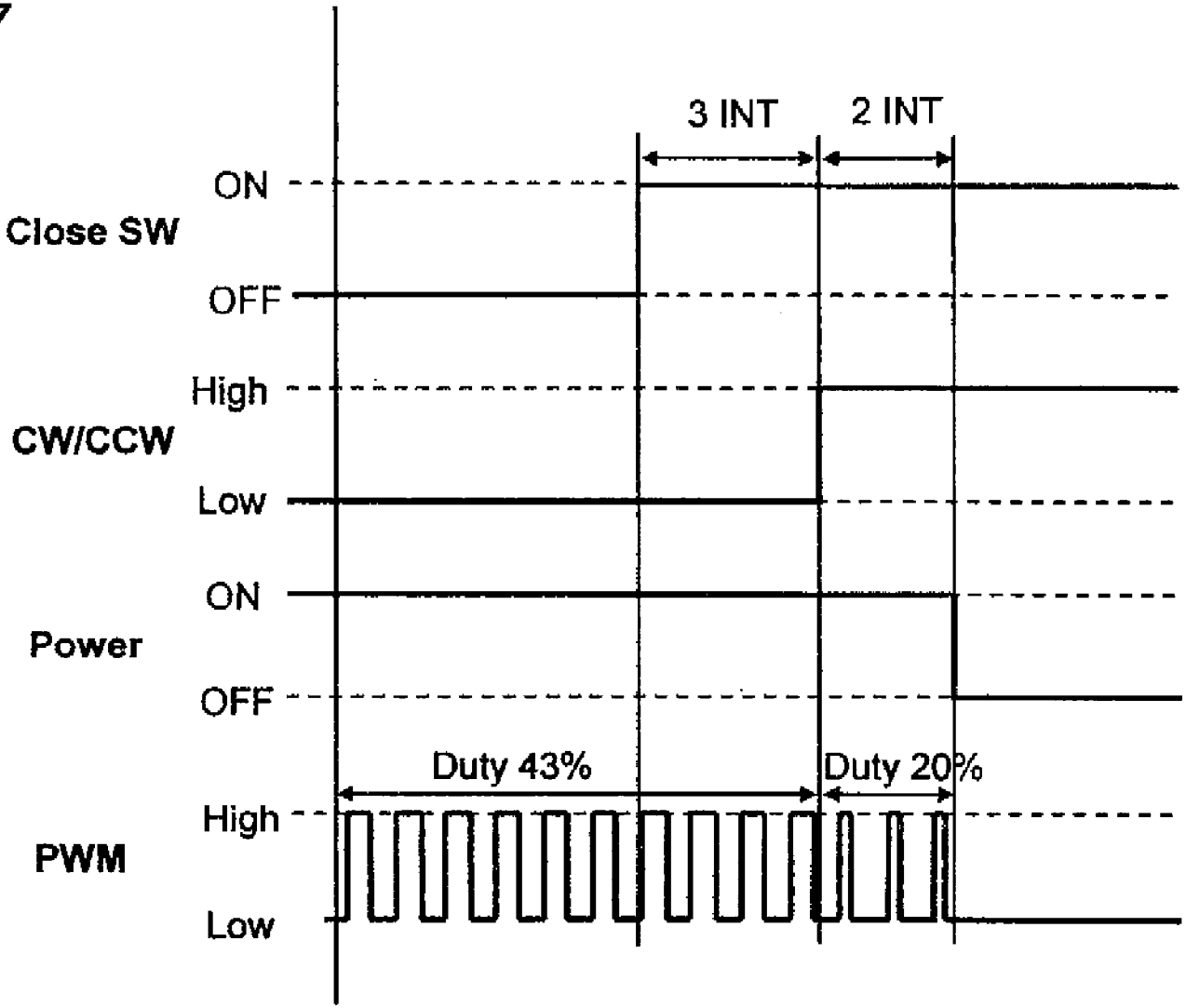
FIG. 7 illustrates one example of a timing chart of power and driving of an electric motor when a close switch is switched ON at the time of closing a door.

FIG. 7 illustrates one example of a timing chart of power and driving of the electric motor when the close switch is switched ON at the time of closing the door. The electric motor 31 is driven by the pulse width control at a duty ratio of 43% and the closing operation of the door is automatically performed. Since the plunger 41 (FIG. 6) is not completely pressed down at the moment when the close switch is switched ON (the same state as that shown in FIG. 6(B)), the duty ratio of 43% is maintained for a period of subsequent 3 INT. When the plunger 41 is completely pressed down (the same state as that shown in FIG. 6(A)), the electric motor 31 is reversely driven by the pulse width control at a duty ratio of 20% for a period of 2 INT in order to reduce the operation force for opening the door. The pulse width control of the electric motor during the reverse rotation is set to be smaller than the operation force of the latch in order not to unhook the latch head. Also, as described above, the output torque of the motor during the reverse rotation is controlled to be a minimum torque by which the motor can be rotated but the door is not opened.

As described above, in the method and device for opening and closing a door according to the present invention, the backlash 37 existing in the transmission mechanism 32, namely, play of the meshing teeth between the rack 35 and the pinion 34, or play between the gears of the reduction gear 33 is maximized to cause the electric motor 31 not to put a load to the manual operation at the time of unhooking the hook at the stroke end of the drawer body 2. When it is detected that the door is fully closed or fully opened by activation of the switch for detecting that the door is fully closed or fully opened, it is possible to immediately control to reversely rotate the electric motor 31 for a predetermined period. Furthermore, the torque of the electric motor during the reverse rotation is set to a minimum torque by which the door is not opened but the motor can be rotated.

Figure 8:
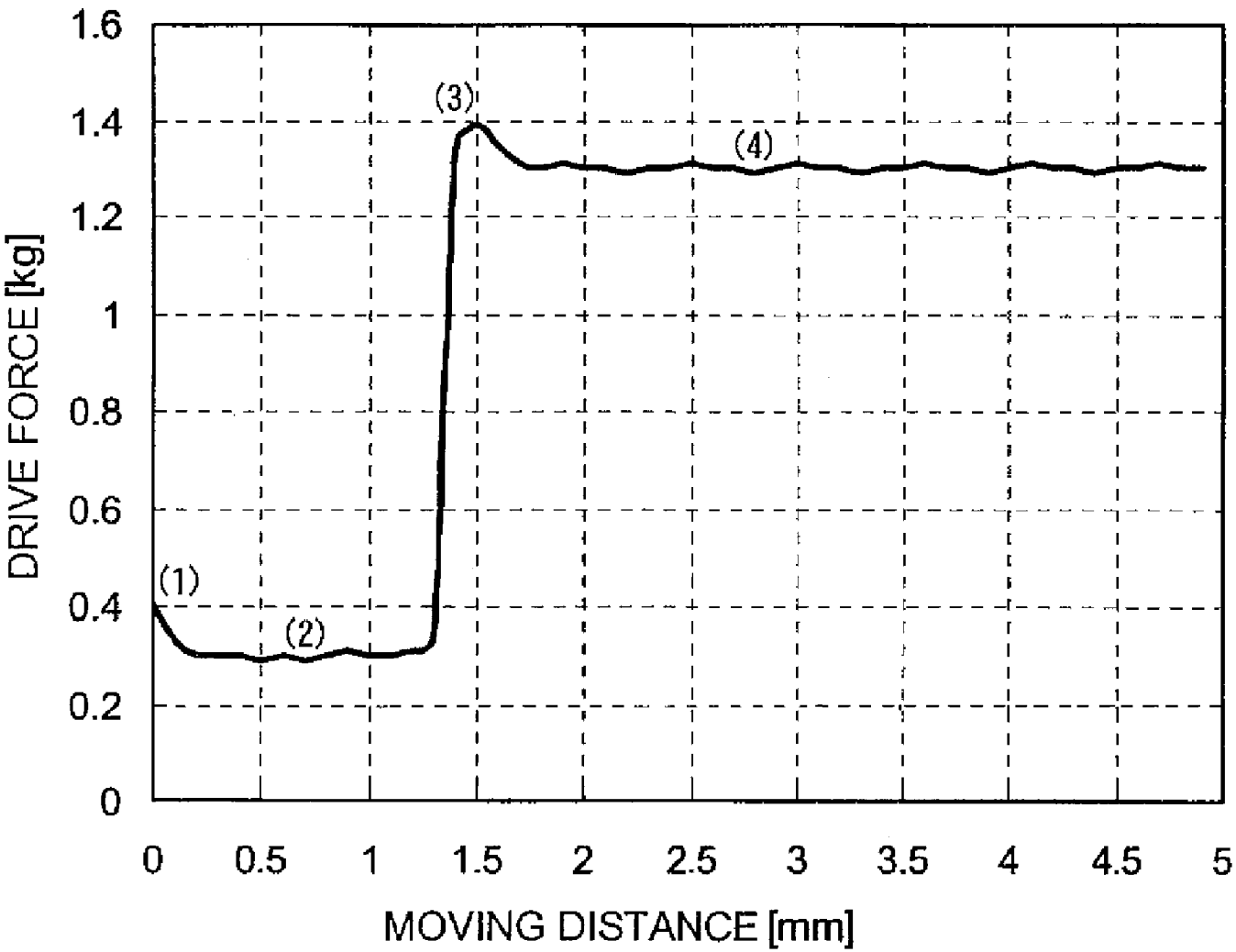
FIG. 8 is a graph illustrating one example of a measurement result of a manual operation force (a drive force) of the device for opening and closing a door shown in FIG. 1.

FIG. 8 is a graph of one example of a measurement result of the manual operation force (the drive force) of the device for opening and closing a door shown in FIG. 1. In the measurement of the drive force, the latch portion was removed and the operation force required to manually move the drawer body was measured at four points. The operation force when the moving distance from the fully closed position was 0 mm was 0.4 kg, which corresponds to a static friction force. The operation force when the door was being moved by the manual operation was 0.3 kg, which corresponds to a dynamic friction force. The operation force when the backlash was absorbed and the drive mechanism (the electric motor) started to be manually driven was the largest value of 1.4 kg, which corresponds to a static friction force including the drive mechanism and the transmission mechanism. The operation force when the drive mechanism (the electric motor) was being manually driven was about 1.3 kg, which corresponds to a dynamic friction force including the drive mechanism and the transmission mechanism. The assisting of the manual operation is activated at 0.8±0.2 mm where the close switch 40 is switched OFF. By using the assisting of the manual operation, the static friction force or the dynamic friction force including the drive mechanism and the transmission mechanism can be reduced.

Conventionally, the backlash has been considered to be absorbed or to be removed in most cases. On the other hand, the drawer-type cooking device to which the present invention is applied utilizes such a nature that a link between the drawer body 2 and the drive mechanism 30 is separated in a zone of the backlash 37 in the transmission mechanism 32. When the drawer body 2 starts to be moved by the manual operation, the drive mechanism 30 is not manually driven in the zone of the backlash 37, and correspondingly, the manual operation force can be reduced. The distance corresponding to the backlash does not necessarily means the entire length of the backlash 37, but also includes the case in which the distance corresponding to the backlash means approximately the entire length of the backlash 37 with some length left over.

What is claimed is:

1. A method for opening and closing a door of a drawer-type cooking device including: a cooking device body having a heating chamber formed therein; a drawer body having a heating container for housing an object to be heated and being drawable from the heating chamber, and a door capable of closing the heating chamber; and a drive mechanism for driving the drawer body in draw-out and push-in directions via a transmission mechanism, the method comprising, at a stroke end of the drawer body corresponding to a fully closed position or a fully opened position of the door, reversely driving the drive mechanism only for a distance corresponding to a backlash existing in the transmission mechanism, and stopping the drive mechanism.

2. The method for opening and closing a door of a drawer-type cooking device according to claim 1, further comprising, in response to that the drawer body reaches the stroke end, reversely driving the drive mechanism for a predetermined period until the distance corresponding to the backlash is absorbed.

3. The method for opening and closing a door of a drawer-type cooking device according to claim 1, further comprising, in response to that the drawer body at the stroke end is manually operated in an opposite direction, starting to drive the drive mechanism in the opposite direction before the drawer body is moved through the distance corresponding to the backlash by the manual operation.

4. The method for opening and closing a door of a drawer-type cooking device according to claim 1, wherein the drive mechanism is an electric motor, and the transmission mechanism comprises a pinion to which a rotation output of the electric motor is transmitted, and a rack attached to the drawer body and meshing with the pinion via the backlash.

5. The method for opening and closing a door of a drawer-type cooking device according to claim 1, wherein the transmission mechanism comprises a plurality of reduction gear stages for increasing a torque, and the backlash is also provided between gears of the reduction gear stages.

6. The method of claim 1, said reversely driving the drive mechanism only for a distance corresponding to a backlash existing in the transmission mechanism, and stopping the drive mechanism including reversely driving and stopping the drive mechanism such that deformation of a bottom plate of a drawer body is prevented.

7. The method of claim 1, where the cooking device is a microwave oven and said reversely driving the drive mechanism only for a distance corresponding to a backlash existing in the transmission mechanism, and stopping the drive mechanism including reversely driving and stopping the drive mechanism such that deformation of a drawer body is prevented, thereby preventing leakage of microwave radiation from the heating chamber into an area surrounding the cooking device.

8. The method of claim 1, where the stroke end of the drawer body corresponding to a fully closed position or a fully opened position of the door is caused by manual opening or closing of the drawer.

* * * * *